US007877911B2

(12) United States Patent
Wynalda, Jr. et al.

(10) Patent No.: US 7,877,911 B2
(45) Date of Patent: Feb. 1, 2011

(54) MERCHANDISE PACKAGE WITH ROTATABLE DISPLAY ELEMENT

(76) Inventors: Robert M. Wynalda, Jr., P.O. Box 370, Belmont, MI (US) 49306; Robert G. Rajter, Jr., P.O. Box 370, Belmont, MI (US) 49306

( * ) Notice: Subject to any disclaimer, the term of this patent is extended or adjusted under 35 U.S.C. 154(b) by 452 days.

(21) Appl. No.: 11/866,829

(22) Filed: Oct. 3, 2007

(65) Prior Publication Data

US 2008/0083145 A1 Apr. 10, 2008

Related U.S. Application Data

(60) Provisional application No. 60/849,104, filed on Oct. 3, 2006.

(51) Int. Cl.
*G09F 11/04* (2006.01)

(52) U.S. Cl. ..... 40/495; 434/404

(58) Field of Classification Search ..... 40/493, 40/495, 113, 114, 115; 229/71, 92.8; 206/308.1; 434/404; 116/223, 298; 33/431
See application file for complete search history.

(56) References Cited

U.S. PATENT DOCUMENTS

| | | | |
|---|---|---|---|
| 2,386,082 | A | 10/1845 | Attridge |
| 2,776,083 | A | 1/1857 | Derman |
| 2,799,391 | A | 7/1857 | Eisner |
| 1,045,257 | A | 11/1912 | Chase |
| 1,143,729 | A | 6/1915 | Schmidt |
| 1,233,404 | A | 7/1917 | Royer |
| 1,686,677 | A | 10/1928 | Bishop |
| 1,998,390 | A | 4/1935 | Stone |
| 2,016,445 | A | 10/1935 | Massey |
| 2,033,998 | A | 3/1936 | Prager |
| 2,854,772 | A | 10/1958 | Hampel |
| 3,103,080 | A | 9/1963 | Desmond |
| 3,180,310 | A | 4/1965 | Giebel |
| 3,321,858 | A | 5/1967 | Bailey |
| 3,471,956 | A | 10/1969 | Walters |
| 3,559,321 | A | 2/1971 | Helms |
| 3,604,134 | A | 9/1971 | Clark |
| 3,718,519 | A | 2/1973 | Montgomery |
| 3,820,263 | A | 6/1974 | Clark |
| 3,939,586 | A | 2/1976 | Clark |
| 4,008,533 | A | 2/1977 | Greenberger |
| 4,132,348 | A | 1/1979 | Bromberg |
| 4,234,079 | A | 11/1980 | Otake |
| 4,329,570 | A | 5/1982 | Koll |
| 4,413,730 | A | 11/1983 | Morse |

(Continued)

*Primary Examiner*—Joanne Silbermann
(74) *Attorney, Agent, or Firm*—Zollinger & Burleson Ltd.

(57) ABSTRACT

A package configuration for holding merchandise includes a rotatable element that selectively displays different information to the user as the element is rotated. The rotatable element is restrained without a central hub or pivot pin. The restraining configuration limits lateral movement and minimizes pinching of the rotatable element. In one configuration, the merchandise storage package has a cover assembly having front and rear covers that define at least one window. Three pocket tabs restrain the lateral movement of the rotatable element. Each pocket tab is integrally folded from the blank used to form the storage package. One of the pocket tabs is double folded over itself to form a spacer having a thickness of three layers of blank material. Another pocket tab is folded over the spacer tab to form a fourth layer of material between the front and back covers.

17 Claims, 7 Drawing Sheets

U.S. PATENT DOCUMENTS

| | | | |
|---|---|---|---|
| 4,958,455 | A | 9/1990 | Jacobsen |
| 5,057,087 | A | 10/1991 | Harmon |
| 5,152,090 | A | 10/1992 | Jacobsen |
| 5,263,586 | A | 11/1993 | Keable |
| 5,370,223 | A | 12/1994 | Leicht |
| 5,374,461 | A | 12/1994 | Bromberg |
| 5,447,769 | A | 9/1995 | Bromberg |
| 6,053,319 | A | 4/2000 | Smith |
| 8,053,325 | | 4/2000 | Yonker |
| 6,070,719 | A | 6/2000 | Pollock |
| 6,085,451 | A | 7/2000 | Riehle |
| 6,393,707 | B1 | 5/2002 | Maffei |
| 7,036,254 | B1 | 5/2006 | Jones |
| 2004/0256256 | A1 | 12/2004 | Preece |
| 2007/0124969 | A1 * | 6/2007 | Busam et al. ..... 40/495 |

* cited by examiner

MERCHANDISE PACKAGE WITH ROTATABLE DISPLAY ELEMENT

CROSS REFERENCE TO RELATED APPLICATIONS

This application claims the benefit of U.S. Provisional Patent Application Ser. No. 60/849,104 filed Oct. 3, 2006; the disclosures of which are incorporated herein by reference.

BACKGROUND OF THE INVENTION

1. Technical Field

The present invention generally relates to merchandise packaging and, more particularly, to merchandise packaging having a rotatable element that moves with respect to a windowed portion of the package to present varying information to the user. The invention relates to the manner in which the rotatable element is held in place.

2. Background Information

A variety of containers are known in the art with movable elements that allow information to be selectively displayed to the user. These containers include sliding elements and rotating elements. Many rotatable elements are mounted on central hubs or pivot pins. Although such mounting configurations are functional, they increase the expensive and difficulty of manufacturing the container. Users of these packages thus desire a merchandise package having a rotatable element that is not carried by a central hub. Such containers should minimize lateral movement of the rotatable element and prevent the element from jamming or pinching.

BRIEF SUMMARY OF THE INVENTION

The invention provides a package configuration for holding merchandise wherein a portion of the package includes a rotatable element that selectively displays different information to the user as the element is rotated. The rotatable element is restrained without a central hub or pivot pin. The restraining configuration limits lateral movement and minimizes pinching of the rotatable element.

In one configuration, the invention provides a merchandise package having a panel that carries a rotatable element that may be moved by a user. The panel defines at least one window that provides visual access to the rotatable element. The rotatable element has different test or graphics regions that are alternatively displayed. The rotatable element is laterally restrained by structures that engage the outer circumference of the rotatable element without the need for a central hub.

In another configuration, the invention provides the structure of the package that laterally restrains the rotatable element without the need for the central hub. This structure includes at least three pocket tabs that capture portions of the outer circumferential edge of the rotatable element. The tabs interlock to define a relatively deep pocket that minimizes the pinching of the rotatable element.

In another configuration, the invention provides a merchandise storage package including the rotatable element. The merchandise storage package has a cover assembly having front and rear covers that define at least one window. The window provides visual access to the rotatable element. Three pocket tabs restrain the lateral movement of the rotatable element. The edge between the front and rear covers functions as a later restraint on the fourth side of the rotatable element. Each pocket tab is integrally folded from the blank used to form the storage package. One of the pocket tabs is double folded over itself to form a spacer having a thickness of three layers of blank material. Another pocket tab is folded over the spacer tab to form a fourth layer of material between the front and back covers. This configuration prevents the covers from pinching the rotatable element. In one embodiment, the merchandise storage package includes a sleeve adapted to receive a media storage container such as a molded DVD container. In another embodiment, the merchandise storage package includes its own storage chamber that may be used to receive a variety of items. The cover assembly may pivot with respect to the holder.

An alternative configuration provides a rear access window in addition to the front window. Another alternative configuration provides an access opening at the edge defined between the front and rear covers. The access opening allows the user to manually rotate the rotatable element within the cover assembly.

BRIEF DESCRIPTION OF THE SEVERAL VIEWS OF THE DRAWINGS

The drawings are not to scale. Similar numbers refer to similar parts throughout the specification.

DETAILED DESCRIPTION OF THE INVENTION

Figure 1:
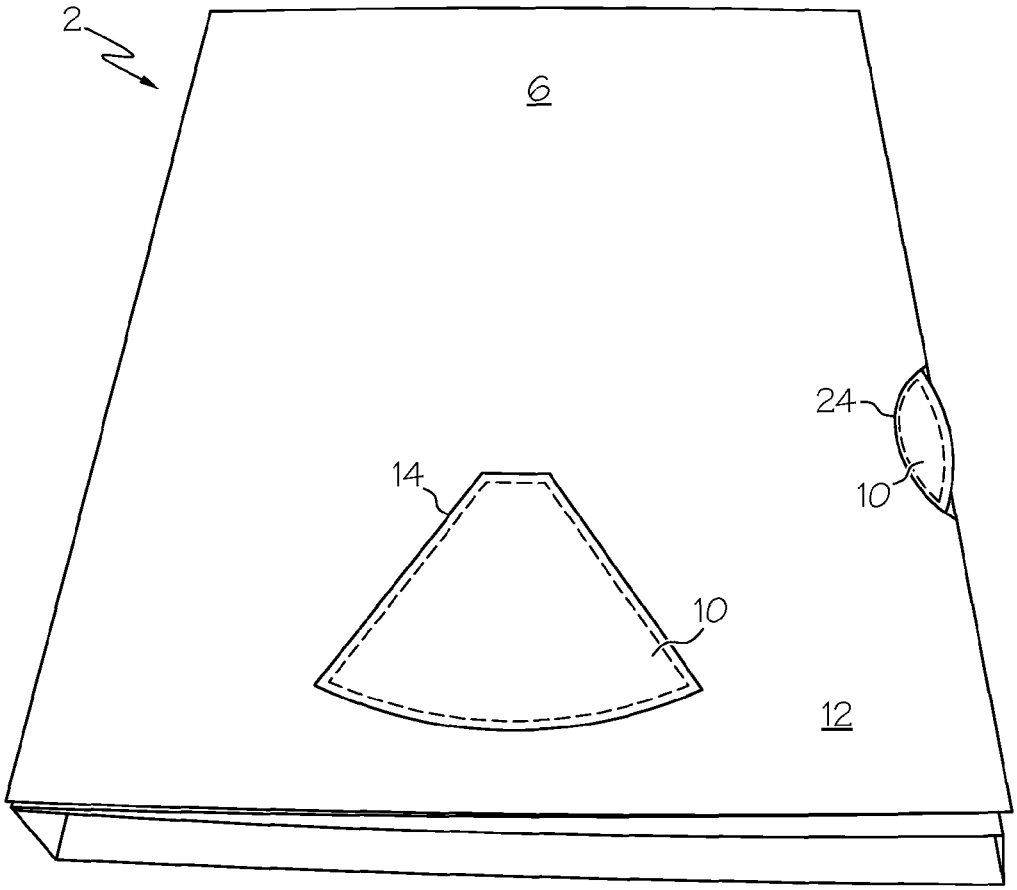
FIG. 1 is a perspective view of the merchandise package with the cover closed showing the front window.

One configuration of the merchandise package of the invention is indicated generally by the numeral 2 in the accompanying drawings. This configuration of package 2 generally includes a merchandise holder 4 and a cover assembly 6 that is pivotably connected to holder 4. Holder 4 is adapted to receive at least one article of merchandise. In the exemplary configuration, package 2 is fabricated from a paper-based material such as a paperboard and the item of merchandise is a molded plastic media storage container such as a DVD container or a CD jewel case. In this exemplary embodiment, holder 4 is in the form of a four-sided sleeve adapted to frictionally engage the media storage container container. In other configurations, holder 4 may be in the form of a unitary card or a six-sided box. Cover assembly 6 may be integral to a wall of holder 4 or may be pivoted to holder 4 as shown in the drawings.

Cover assembly generally has a top, bottom, and lateral edges disposed in the orientation shown in FIG. 1. Unless specifically noted, the inner surface of a member of cover assembly 6 is the surface facing the inner storage area of cover assembly while the outer surface is the viewable surface that is printed with promotional material. When cover assembly 6 is non-pivotably secured to holder 4, the outer surface of cover assembly 6 includes the surface that faces, is connected to, or forms one of the walls of, holder 4. Cover assembly 6 includes a rotatable element 10 rotatably movable to display different information through at least one window defined by cover assembly. Cover assembly 6 includes a front cover 12 that defines a front window 14 that is aligned with a portion of rotatable element 10. Window 14 may be essentially any shape with the wedge shown in the drawings being exemplary.

Figure 2:
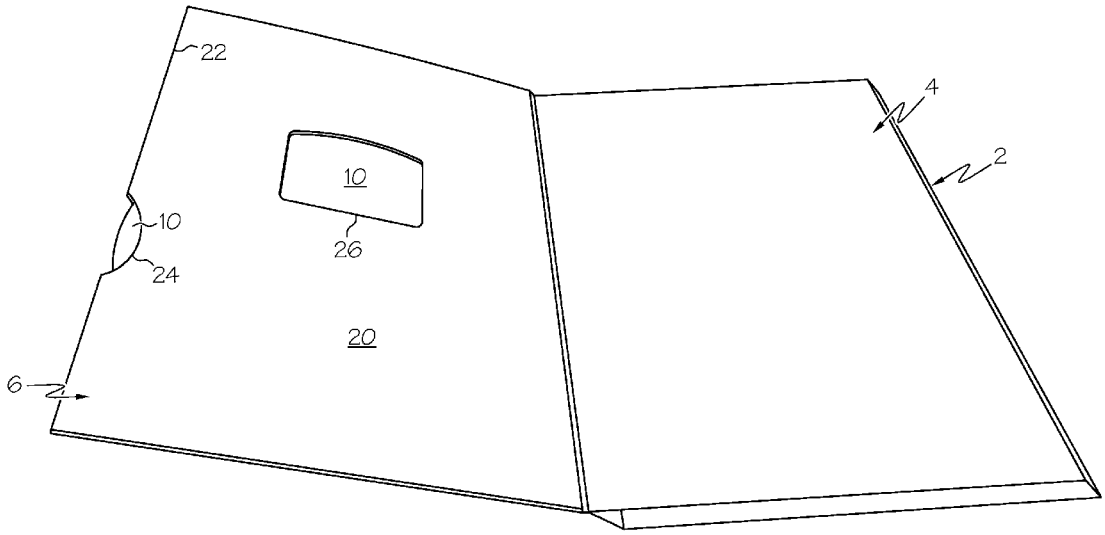
FIG. 2 is a perspective view of the merchandise package with the cover open showing the rear window.

In the exemplary configuration, cover assembly 6 is attached to holder 4 with a living hinge that allows cover assembly 6 to pivot open to expose the front surface of holder 4 and the rear surface of cover assembly 6 (as shown in FIG. 2). These areas may be used to display information relevant to the item of merchandise carried by package 2. The position of cover assembly 6 also may be fixed with respect to holder 4.

Cover assembly 6 includes a front cover 12 and a back cover 20. Covers 12 and 20 may be formed by folding a portion of a blank along a first fold 22. Portions of front 12 and back 20 covers define portions of an access opening 24 that is divided by first fold 22 when front cover 12 is folded over back cover 20. A portion of rotatable element 10 is always exposed though access opening 24 so that the user may contact element 10 and rotate it so that different portions of rotatable element 10 are alternatively displayed through window 14.

An optional rear window 26 aligned with a portion of element 10 is defined by back cover 20. Rear window 26 allows both the front and rear side of element 10 to be used for information to be display to the user.

Figure 3:
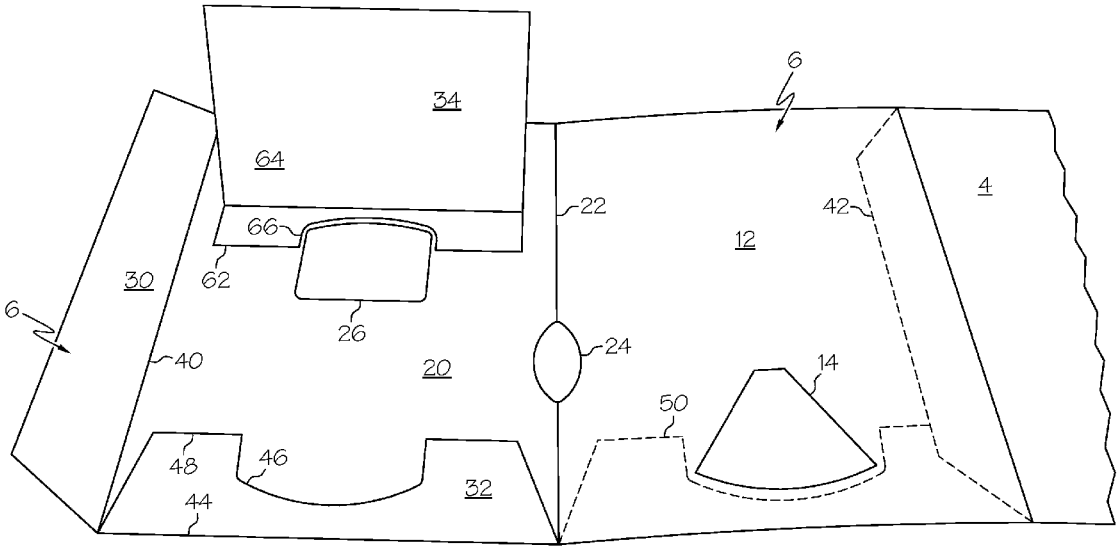
FIG. 3 is a perspective view of the cover of the merchandise package with the front and back covers folded open to expose the pocket tabs.

Cover assembly 6 includes first 30, second 32, and third 34 pocket tabs that cooperate with front cover 12 and back cover 20 to define a pocket that rotatably receives element 10. First pocket tab 30 is connected to back cover 20 with a second fold 40 that defines the edge of back cover 20 opposite to first fold 22. Tab 30 has a length substantially equal to the height of cover 20 with its ends tapered inwardly. Tab 30 has a width (direction transverse to fold 40) large enough so that an inner portion of tab 30 overlaps at least the edges of second 32 and third 34 pocket tabs when cover assembly 6 is assembled. When package 2 is assembled, tab 30 is directly connected to the inner surface of front cover 12 at the area identified by dashed line 42 in FIG. 3. An adhesive or a mechanical connector may be used to form this connection.

Figure 4:
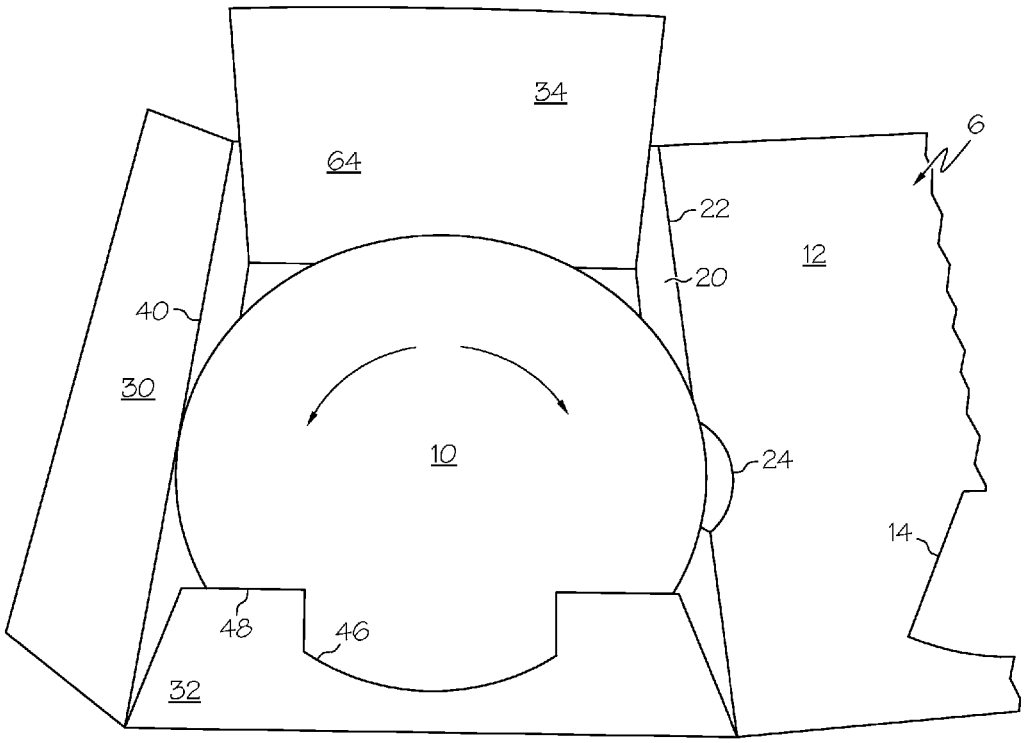
FIG. 4 is a perspective view similar to FIG. 3 showing the rotatable element placed on the front cover.

Second pocket tab 32 is connected to the bottom edge of back cover 20 with a third fold 44. Second pocket tab 32 has a width substantially equal to the width of back cover 20 with its ends tapered inwardly in a manner similar to tab 30 so that cover assembly 6 will fold to a closed configuration without interference. Tab 32 defines a notch 46 at its upper edge 48 that prevents tab 32 from blocking window 14. Notch 46 may be aligned with and help form a portion of window 14. In the exemplary configuration, the lower edge of notch 46 is curved to match the bottom edge of window 14. FIG. 4 shows how second tab 32 receives the bottom portion of rotatable element 10 while the edge of element 10 is disposed in access opening 24. The inner surface of tab 32 is not directly connected to the inner surface of cover 20. When package 2 is assembled, the outer surface of tab 32 is directly connected to the inner surface of front cover 12 at the area identified by dashed line 50 in FIG. 3. An adhesive or a mechanical connector may be used to form this connection. Tab 30 is designed to fold over the top of tab 32.

Figure 5:
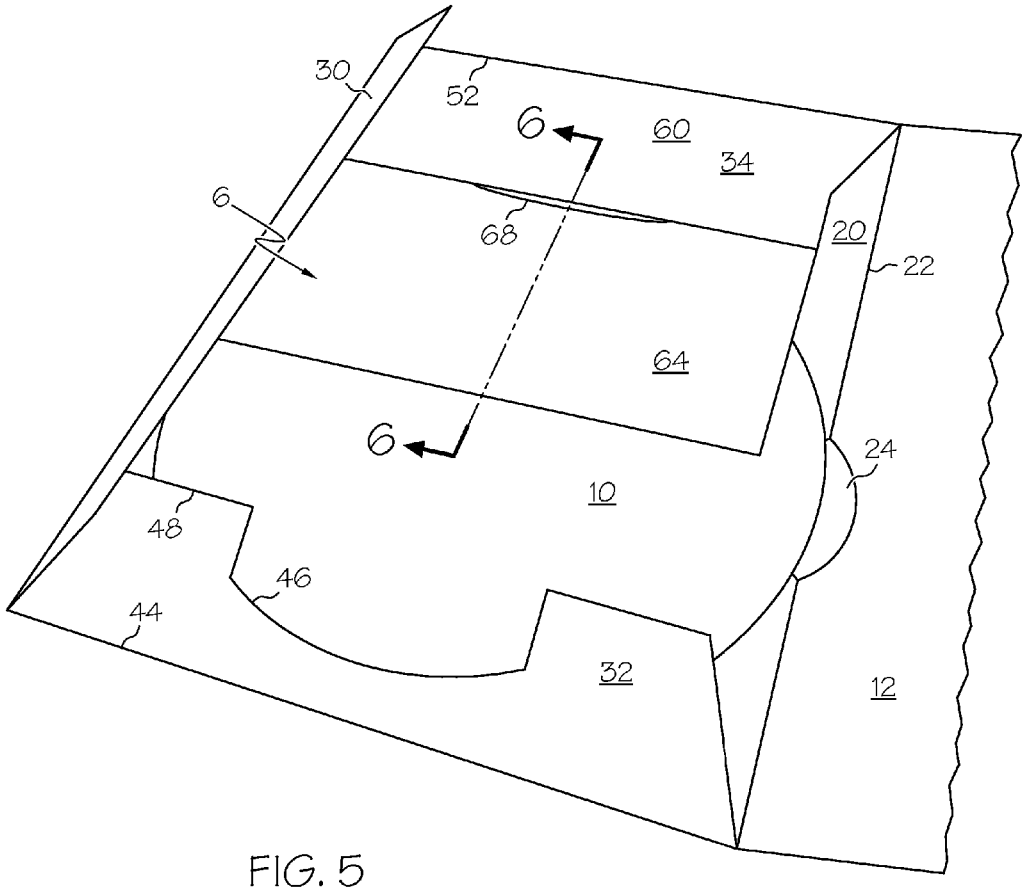
FIG. 5 is a perspective view showing the tabs folded over the rotatable element.
Figure 6:
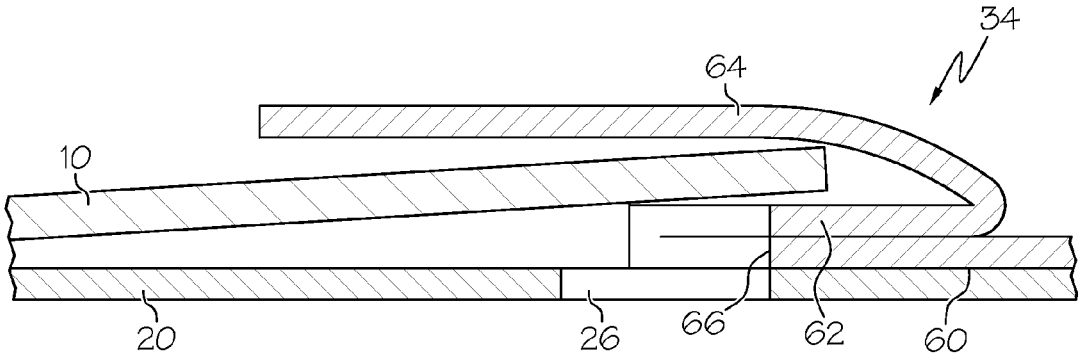
FIG. 6 is a section view taken through line 6-6 of FIG. 5.
Figure 7:
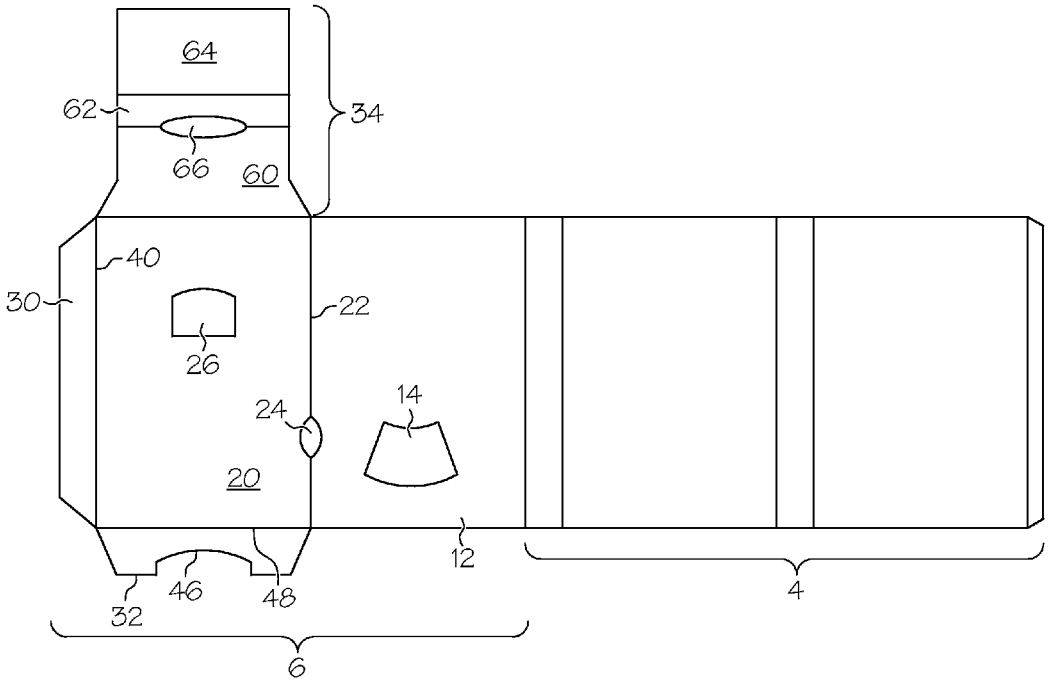
FIG. 7 is a top plan view of a blank used to form the package (the rotatable element is not shown).

Third pocket tab 34 is connected to the top edge of back cover 20 with a fourth fold 52. Third pocket tab 34 has a width substantially equal to the width of back cover 20 but tab 34 is tapered inwardly so that cover assembly 6 will fold to a closed configuration without interference. Third pocket tab 34 includes first 60, second 62, and third 64 portions that double back over each other to form a deep upper pocket for element 10. First portion 60 is connected to fold 52 and may be directly connected to the inner surface of cover 20 with a connector such as an adhesive or a mechanical connector. Second portion 62 is folded back on top of first portion 60 and directly secured (by adhesive or other connectors) to first portion 60 to form a spacer that increases the depth of the pocket that receives rotatable element 10. When back cover 20 includes window 26, first and second portions 60 and 62 may define a notch 66 that is aligned with window 26 (see FIG. 6). Third portion 64 is folded back over second portion 62 to form an upper pocket for element 10. The fold line may be slit (identified by numeral 68 in FIG. 5) to ensure that third portion 64 does not spring back open during assembly of cover assembly 6. The configuration of third pocket tab 34 places four layers (three layers from tab 34 and one layer from tab 30) of material between covers 12 and 20 when cover assembly 6 is assembled. This configuration provides room for element 10 to move within cover assembly 6. As shown in FIG. 6, rotatable element 10 is raised up on two layers 60 and 62 of material at its upper end. This configuration helps prevent pinching and allows the user to easily rotate element 10.

Third portion 64 and tab 32 are simply folded under tab 30. Adhesive between the inner surface of tab 30 and the outer surfaces of portion 64 and tab 32 is optional. The connection between the outer surface of tab 30 and the inner surface of cover 12 secures portion 64 and tab 32 in place.

Element 10 is rotatably received between covers 12 and 20 with three of its portions in the pockets defined by tabs 30, 32, and 34 and a fourth portion received in access opening 24 with fold 22 retaining it in that direction. The center of element 10 is not connected to cover assembly 6 by any central hub or spindle. Element 10 is thus loosely disposed within cover assembly 6. When a user rotates element 10, the user will either push element 10 against fold 40 or pull element 10 against the edges of fold 22 through opening 24. In either situation, element 10 is not pinched by cover assembly 6. In addition, element is stable while the user rotates element 10 to expose different sections of element 10 through windows 14 and 26.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention is an example and the invention is not limited to the exact details shown or described. For example, each of pocket tabs 30, 32, and 34 are described above as being integrally formed from a single blank and formed with folds. In an alternative configuration, each tab 30, 32, and 34 may be separately formed ad connected to cover 12 or 20 with adhesive or mechanical connectors such as rivets, staples, folded punch tabs, and the like. In addition, cover 12 may be secured to cover 20 with adhesive or mechanical connectors. Cover assembly 6 may be connected to holder 4 with a hinge pin or hinge pins. Holder 4 may be a sleeve, a box or tube, an envelope, or other type of container that holds merchandise.

The invention claimed is:

1. A merchandise package comprising:

a holder adapted to receive an item of merchandise;

a cover assembly associated with the holder; the cover assembly including a front cover and a rear cover; one of the covers defining a first window;

the cover assembly having first, second, and third pocket tabs that define first, second, and third pockets;

the first, second, and third pocket tabs being disposed between the front and rear covers;

a rotatable element rotatably carried by the cover assembly; a portion of a first side of the rotatable element being accessible through the first window;

portions of the rotatable element being disposed in the first, second, and third pockets; and a portion of one of the pocket tabs defining a portion of the first window.

2. The package of claim 1, wherein the front and rear covers define an access opening separate from the first window that provides access to a portion of the rotatable element so that a user can rotate the rotatable element with respect to the cover assembly.

3. The package of claim 2, wherein the access opening is diametrically opposed across a diameter of the rotatable element to a portion of the first pocket tab.

4. The package of claim 1, wherein the cover assembly is pivotably connected to the holder.

5. The package of claim 1, wherein each of the pocket tabs is connected to one of the covers at a fold.

6. A merchandise package comprising:

a holder adapted to receive an item of merchandise;

a cover assembly associated with the holder; the cover assembly including a front cover and a rear cover; one of the covers defining a first window;

the cover assembly having first, second, and third pocket tabs that define first, second, and third pockets;

the first, second, and third pocket tabs being disposed between the front and rear covers;

a rotatable element rotatably carried by the cover assembly; a portion of a first side of the rotatable element being accessible through the first window;

portions of the rotatable element being disposed in the first, second, and third pockets; and a portion of one of the pocket tabs being folded over itself to define first, second, and third portions of the folded-over pocket tab; the first and second portions being directly adjacent; and a portion of the rotatable element being disposed between the third portion and the second portion.

7. The package of claim 6, wherein the holder is a sleeve adapted to receive a plastic DVD container.

8. The package of claim 7, wherein the cover assembly and holder are integrally formed.

9. The package of claim 8, wherein the cover assembly and holder are fabricated from paperboard.

10. The package of claim 6, wherein the third portion is connected to the second portion with a fold; the fold being slit.

11. The package of claim 6, wherein the first and second portions define a notch; the notch being aligned with the first window.

12. The package of claim 6, wherein the front and rear covers define an access opening providing access to a portion of a circumferential edge of the rotatable element so that a user can rotate the rotatable element with respect to the cover assembly.

13. The package of claim 12, wherein the access opening is diametrically opposed across a diameter of the rotatable element to a portion of the first pocket tab.

14. The package of claim 6, wherein the cover assembly is pivotably connected to the holder.

15. The package of claim 6, wherein each of the pocket tabs is connected to one of the covers at a fold.

16. The package of claim 15, wherein the first pocket tab has an outer surface adhered to an inner surface of the other cover; the second pocket tab having an outer surface adhered to the inner surface of the other cover.

17. The package of claim 6, wherein the other cover defines a second window.

* * * * *